US006504087B2

(12) United States Patent
Shulman

(10) Patent No.: US 6,504,087 B2
(45) Date of Patent: Jan. 7, 2003

(54) STABILIZING DEVICE FOR SMALL BRASS MUSICAL INSTRUMENTS

(76) Inventor: Matthew Shulman, 226 W. 242nd St., Riverdale, NY (US) 10471

( * ) Notice: Subject to any disclaimer, the term of this patent is extended or adjusted under 35 U.S.C. 154(b) by 0 days.

(21) Appl. No.: 09/779,922

(22) Filed: Feb. 8, 2001

(65) Prior Publication Data

US 2002/0007716 A1 Jan. 24, 2002

Related U.S. Application Data

(60) Provisional application No. 60/217,295, filed on Jul. 11, 2000.

(51) Int. Cl.[7] ..... G10D 7/10

(52) U.S. Cl. ..... 84/387 A; 84/327; 84/453; 84/328; 84/329

(58) Field of Search ..... 84/387 A, 327, 84/421, 453, 328, 329

(56) References Cited

U.S. PATENT DOCUMENTS

| | | | | |
|---|---|---|---|---|
| 413,807 A | | 10/1889 | Venth | 84/281 |
| 2,241,750 A | * | 5/1941 | Strane | 84/395 |
| 3,024,690 A | | 3/1962 | Sanstead | 84/387 A |
| 3,192,817 A | | 7/1965 | Schmidt | 84/327 |
| 3,811,357 A | | 5/1974 | Stewart | 84/327 |
| 3,955,461 A | | 5/1976 | Ivie | 84/327 |
| 4,065,994 A | | 1/1978 | Streit | 84/453 |
| 4,913,027 A | | 4/1990 | Twohy | 84/280 |
| 5,528,971 A | | 6/1996 | Wood | 84/327 |
| 5,544,560 A | | 8/1996 | Biasini | 84/387 A |
| 5,664,758 A | | 9/1997 | Smith | 248/688 |
| 5,789,687 A | | 8/1998 | Johnson | 84/387 A |
| 5,894,098 A | * | 4/1999 | Hsieh | 84/387 A |

* cited by examiner

*Primary Examiner*—Shih-Yung Hsieh
(74) *Attorney, Agent, or Firm*—Fish & Richardson P.C.

(57) ABSTRACT

A stabilization device for a smaller brass instrument includes a first element that rests on the chest of a user of the instrument and a second element that provides a pivoting balance for the instrument.

34 Claims, 2 Drawing Sheets

STABILIZING DEVICE FOR SMALL BRASS MUSICAL INSTRUMENTS

CROSS-REFERENCE TO RELATED APPLICATION

This application is a continuation of U.S. Provisional Application Serial No. 60/217,295, filed Jul. 11, 2000, and entitled "Stabilizing Device For Small Brass Musical Instruments", which is hereby incorporated by reference in its entirety.

TECHNICAL FIELD

This invention relates to a stabilizing device for a musical instrument.

BACKGROUND

Players of the smaller brass instruments, such as trumpet, trombone and French horn, have all too often sacrificed embouchure, posture, breathing, tone, dexterity and/or endurance for the sake of stabilizing and supporting their instruments. They have naturally tended toward excess mouthpiece pressure, and excess body tension, and extreme embouchure as ways of stabilizing their instrument while it is played, since their instrument's center of gravity shifts as they move its valves, slides and triggers, and as they move their own bodies. There is a need for a device for smaller brass instruments which offers flexible, natural-feeling stabilization and support for smaller brass instruments while preserving freedom of movement.

SUMMARY

The invention features a device which will support, stabilize, and balance smaller brass instruments while preserving freedom of movement. Concurrently, the device preferably also will vibrate in response to the vibration of the player's instrument, providing the experience of body/instrument resonance.

By reducing the physical tensions which are not helpful in producing musical sound, the device promotes a more focused and efficient use of those parts of the body that contribute to musical sound, the device promotes a more focused and efficient use of those parts of the body that contribute to musical sound. As a result, the player is less prone to "fight the horn" and better able to focus on the music. By providing a resonating link between the instrument and the player's body, the device helps bring out the applied instrument's core sound and utilize more of the natural resonance of the player's body, especially in the area of the player's breastbone or sternum.

In addition to being a help to performance, the device functions as a learning or awareness-tool, allowing the player to develop greater sensitivity to the subtle sensations that involved in playing well. It can be used in this way by students and professionals at all levels.

Generally, the device includes a first element that rests on the chest of the user connected to a second element that provides a pivoting balance for the instrument. Connected, as used herein, includes connection through intermediate structure.

Preferred embodiments of the device may include one or more of the following features. The device may include a neck strap that slip over the user's neck and attaches to the first element, for example, through a key ring. The first element can include a flat piece that rests on the sternum of the user. The device may further include an arm element connected to the first element that pivots vertically with respect to the first element. The device may further include an extension assembly that adjustably extends the upper arm and provides a pivotal point of attachment for the second element. The second element may be a cradle that can serve as a pivot and point of contact for the instrument; the cradle may also serve as a resting point or contact point for the hand of a user.

The invention also features a method of stabilizing a small brass instrument using the stabilizing device.

The device may also include any of the features described in the description of the prototype or shown in illustrations of the device.

Other features and advantages of the invention will be apparent from the detailed description, and from the claims.

DETAILED DESCRIPTION

Figure 1:
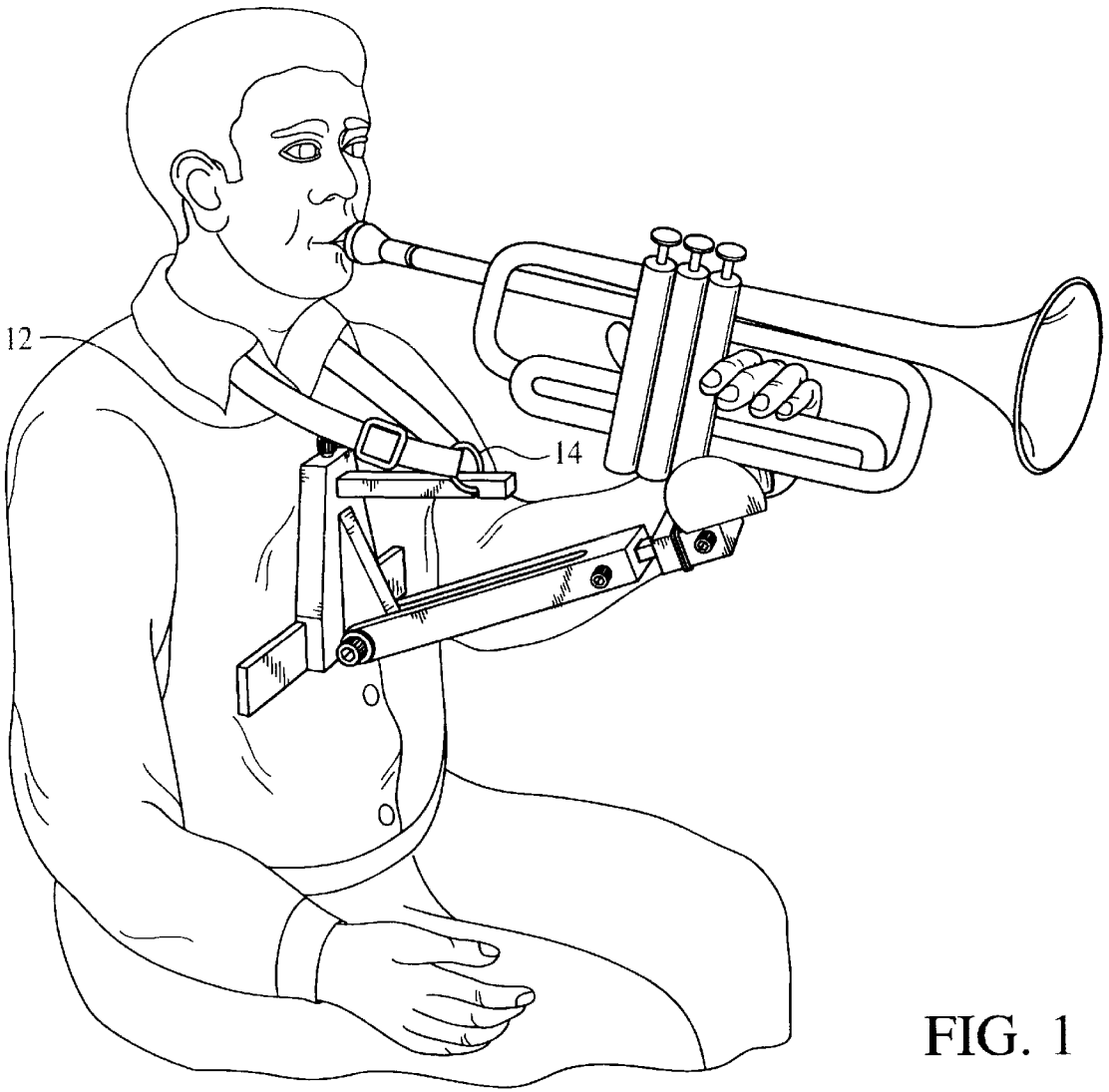
FIG. 1 is a perspective view of a stabilization device being used by a trumpet player.
Figure 2:
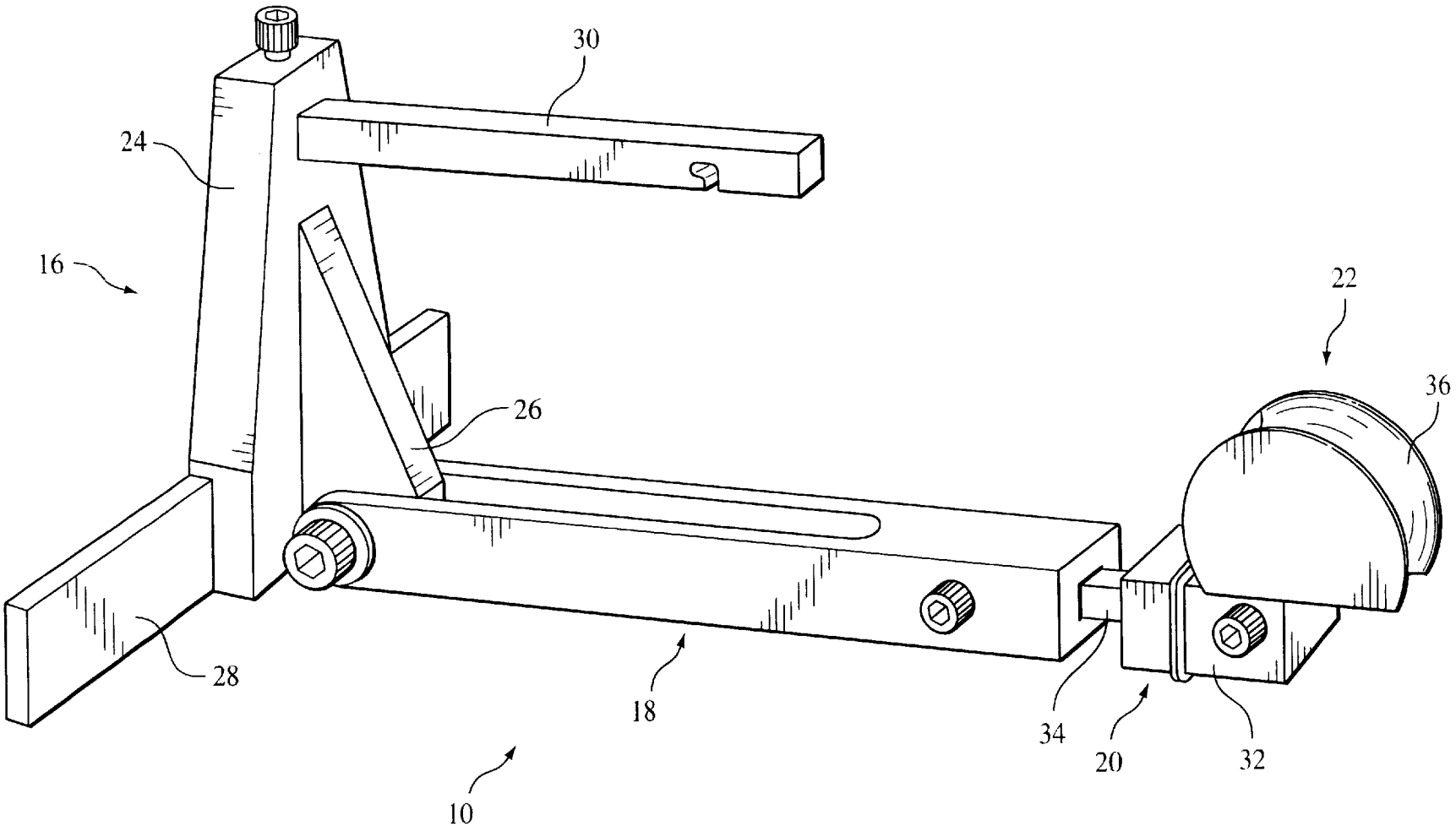
FIG. 2 is a closer perspective view of the stabilization device in FIG. 1, without neck strap and key ring.

Referring to the Figures, stabilization device 10 includes neck strap 12 and key ring 14, breastplate assembly 16, upper arm 18, forearm and extension rod assembly 20, and cradle and pivot-dowel assembly 22. The breastplate assembly, upper arm, forearm and extension rod assembly, and cradle and pivot device assembly are made from maple wood and pivotally joined with standard hardware fittings. Some of the components are named after parts of the human body, inasmuch as they extend outward from the players body in much the same way as an imaginary third arm might if it were reaching forward from the player's sternum to provide balanced support for the instrument. The description lists the component parts in the order of their proximity to the player's body, beginning with the neck strap and key ring, and ending with the cradle and pivot-dowel assembly, upon which the player's instrument ultimately balances. The descriptions of the component parts instruct the player in the use of the prototype and allow a person skilled in woodworking, including lathe turning, to make a prototype.

N.B. The following definitions used in conjunction with the drawings apply to the detailed descriptions of all parts of the device.

Right (or left) surface (or side) refers to a surface as seen by the player looking at the right (or left) of the device while wearing it.

Top (or upper) surface refers to a surface as seen by the player looking down on the device while wearing it.

Bottom (or lower) surface refers to the surface as seen by the player after turning the device upside down.

Forward surface (or front end) of a part is that surface furthest from the player's chest as the device is being worn.

Back surface (or back end) of a part is the surface closest to the player's chest as the device is worn.

1) NECK STRAP 12 AND KEY RING 14: The neck strap and key ring form an assembly which slips over the player's neck. The neck strap is a belt of webbed nylon material 1 inch wide by 26 inches long, with each end of the belt sewn around the rim of the key ring so as to form a closed loop. The neck strap suspends the key ring at the top of the player's sternum (approximately at the level of the player's collarbone). The key ring is a standard hardware item, 1 and ¼ inches in diameter by ⅛ inch thick. A pair of adjustment buckles allows the player to shorten the loop of the neck strap once it has been placed over the player's head, allowing the player to position the breastplate assembly comfortably within the area of the sternum.

2) BREASTPLATE ASSEMBLY 16: The prototype breastplate assembly includes plate 24, tongue 26, wing 28, and balance beam 30.

a) Plate 24 is formed from a rectangle of maple wood, five inches long by 1 and ¾ inches wide by ½ inch thick. The side lengths are then tapered toward the top surface by drawing a taper-line from a point 1 and ¼ inches above the bottom right edge to a point ¼ inch from the top right edge (a symmetrical taper-line is then drawn on the left side of the plate). The rectangle is cut along these taper-lines to form the final six-sided shape of the plate. The top of the plate is then 1 and ¼ inches long by ½ inch wide, the bottom of the plate is 1 and ¾ inches long by ½ inch wide, a line perpendicular to the top and the bottom would be 5 inches long, the bottom 1 and ¼ inches of the length forms a rectangle with the right and left surfaces, and the upper 4 and ¾ inches of the length forms a trapezoid with the right and left surfaces.

On the front surface of the plate, a groove four inches long by ⅜ inch wide by ¼ inch deep is cut, running up from the bottom and along the longitudinal axis of the plate and ending 1 inch below the top. This groove serves to receive the tongue of the breastplate assembly.

Beginning ⅜ inch below the top of the plate and ending ⅞ inch below the top of the plate and centered in the upper surface of the plate, a mortise ⅜ inch wide by ½ inch long is chiseled through from front to back. This mortise serves to receive the balance beam of the breastplate assembly.

The center point on the top surface of the plate is tapped with a 10–24 tap, to intersect the mortise. This threaded hole serves to receive the 10–24×½ inch socket-head cap screw that tightens the balance beam of the breastplate assembly in the mortise. It also allows removal of the balance beam for travel.

On the back of the plate, a rabbet 1 and ¼ inch wide and ⅛ inch deep is made along the bottom edge. The center point of the rabbeted area is drilled to a depth of ½ inch and tapped with a 10–24 tap to make a threaded hole for the 10/24 by ½ inch socket-head cap screw that secures the wing of the breastplate assembly to the back of the plate. The rabbet allows the wing of the breastplate assembly the fit flush with the back of the plate.

b) Tongue 26 is glued firmly into the groove of the plate and serves to provide an attachment point through which the arm and cradle assembly can vertically pivot. (Note that the tongue is the only wooden piece in which the grain of the wood runs with the width of the piece, rather than its length, in order to provide greater strength at the point where the arm and cradle assembly are attached.)

The tongue is formed from a maple rectangle which is 4 inches long by 1 and ¼ inches wide by ⅜ inch thick. A hole 25/64 inches in diameter is then drilled through a point ⅜ inch up from the bottom edge of the tongue and ⅜ inch back of its front edge. This hole serves as the attachment hole for the arm.

The tongue is modified from its initial rectangular shape by locating a point on the right front edge which lies ¾ inch up from the bottom, drawing a diagonal line to connect this point with the point on the right top edge of the rectangle which lies ¼ inch forward of the back edge, and cutting through this diagonal line. The 4 inch back side of the tongue is then glued firmly into the groove of the plate, its bottom side flush with the bottom of the plate.

c) Wing 28 serves to provide horizontal stability for the breastplate assembly as it contacts the player's chest and to distribute the weight of the player's chest. It is a five inch long by 1 and ¼ inch wide by ⅛ thick rectangle of flexible, high-strength, transparent plastic with a 3/16 diameter hole drilled through the center of its back, to allow the wing to be secured into the rabbet of the plate by a 10–24 by ½ inch socket-head cap screw. This cap-screw may be loosened by hand to allow the wing to be folded in line with the plate for travel.

d) Balance beam 30 serves to provide a notched point of attachment from which to suspend the device from the neck strap and key ring. The notch is located approximately above the center of gravity of the device when the forearm is in its extended position (about 3 inches forward of the arm). It thereby provides balanced contact of the plate and wing against the player's chest, allowing the device to better balance the player's instrument.

The balance beam is a maple rectangle 4 and ½ inches long by ½ inch wide by ⅜ inch thick, with a notch ½ inch back of its front end, to receive the key ring of the neck strap.

A hole 9/64 inch in diameter is drilled through the thickness of the beam at a point ½ inch from the front-end and 3/16 inch above the bottom. This hole allows for slight free-play of the key ring. A key ring insertion notch is then formed by making two cuts up from the bottom edge to intersect the hole. The front cut is perpendicular to the length of the beam and tangential to the circumference of the hole. The back cut, made ⅛ inch back of the first cut, is also perpendicular to the length of the beam, and intersects the circumference of the hole. The notch thus formed serves to receive a key ring which is 1 and ⅜ inches in diameter and ⅛ inch thick. The proper sizing of the notch allows the key ring to be inserted and removed, allows for slight free-play of the key-ring in its hole, and assures that the key-ring will seat securely in the beam while the device is in use.

3) UPPER ARM 18: The upper arm pivots vertically at the tongue hole of the breastplate assembly. It is formed from a maple rectangle 6 inches long by ¾ inch wide by ¾ inch thick. A 25/64 inch hole is drilled through the rectangle's entire thickness at a point ½ inch forward of the back edge and ⅜ inch up from the bottom of the right side.

At the front-end of the arm, a ⅜ inch by ⅜ inch mortise is chiseled through the center of the front surface, to a depth of 1 and ¾ inches. This mortise serves to receive the extension rod of the forearm assembly.

On the right side of the arm, at a point ¾ inch from its front end and ⅜ inch from its bottom edge, a 10–≧threaded hole is tapped to a depth of ⅜ inch, to receive the 10–≧by ½ inch socket-head cap screw that serves to set the adjustment of the extension rod.

Starting from the back surface and straddling the longitudinal axis of the arm, a grove 4 and ½ inches long by ⅜ inches wide, by ¾ inches deep is cut through from top to bottom stopping 1 and ½ inches back of the front surface. This groove serves to accommodate the length of the extension rod. It also allows the arm to fold around the tongue, jackknife-style, for travel.

The back end of the arm is then rounded-off to a ¾ inch diameter semicircle, without sacrificing length of the arm. This allows the arm to pivot vertically even as its back end contacts the plate of the breastplate assembly.

The arm is attached to the tongue-hole of the breastplate assembly by means of a 5/16 by 1 inch socket-head cap screw and 5/16 washer inserted from the right side of the arm, and a 5/16–18, 1/8 inch by 7/8 inch tee-nut fastener inserted from the left. A 1/4 inch allen wrench is used to tighten the 5/16 socket-head cap screw, allowing the player to fix the arm securely at any point in its vertical pivot.

4) FOREARM AND EXTENSION ROD ASSEMBLY 20: Forearm 32 serves to extend the forward reach of the arm from the player's chest. It consists of a 2 inch long by 3/4 inch wide by 3/4 inch thick piece of maple. Its back surface has a 3/8 inch by 3/8 inch mortise cut through its center point to a depth of 3/4 inch, to receive extension rod 34.

At a point 3/8 inch back of the top-front edge and centered with the longitudinal axis of the forearm, a 3/8 inch diameter hole is drilled from top to bottom. This hole serves to receive the cradle pivot-dowel.

On the right surface, at a point 3/8 inch back of the front surface and on a line parallel with the longitudinal axis of the forearm, a 10–≧threaded hole is tapped to intersect the pivot-dowel hole. This threaded hole serves to receive the 10–≧by 1/2 inch socket-head screw cap that loosely fits into the groove on the circumference of the cradle pivot-dowel.

At two points back of the pivot-dowel hole (placement to be determined by player) two #16 rubber O-rings are applied about the circumference of the forearm. The O-rings serve as a moisture-ridge, to keep any moisture that might come out of the bottom valve-cap hole of the instrument's third valve from flowing into the pivot-dowel hole and causing swelling of the wood in that area.

Extension rod 34 is of maple wood, 5 and 1/4 inches long by 3/8 inch wide by 3/8 inch thick. It is glued firmly into the mortise of the forearm, but must move easily through the mortise and groove of the upper arm unless its position is fixed by tightening the cap screw at the front end of the upper arm.

5) CRADLE AND PIVOT-DOWEL ASSEMBLY 22: Cradle 36 serves as a horizontally pivoting point-of-contact for the player's instrument and also provides a rest or contact point for the player's left hand. The cradle is lathe-turned from a piece of maple rode 3 inches long by 2 inches in diameter, so as to have the two ends of the rod taper conically toward the middle, at which point the diameter is 1/2 inch. The resulting double-cone is then cut from end-to-end through its length, so as to shear off the bottom 3/4 inch of the double-cone and produce a flat bottom surface that rests freely upon the top surface of the forearm. The twin conical shoulders of the resulting figure rise up from the base, providing a conical V-groove that can snugly yet freely cradle the balance point of the player's instrument and accommodate varying diameters of tubing.

A 3/8 inch diameter hole is then drilled through the center point of the base of the cradle to a depth of 3/8 inch. This hole serves to receive the cradle pivot-dowel (not shown).

The pivot-dowel allows the cradle to rotate horizontally on top of the forearm. It is 1 and 1/8 inch long by 3/8 inch diameter maple dowel, with 3/16 inch wide by 1/32 inch deep lathe-turned groove. The groove evenly straddles a circumference line drawn 3/8 inch above the bottom end of the dowel. The groove allows the pivot-dowel to rotate within the forearm hole, the dowel being held loosely by its light contact with the tip of the pivot-dowel cap screw within the groove. The top end of the pivot-dowel is glued firmly into the full depth of cradle hole to form the cradle and pivot-dowel assembly.

Other Embodiments

Other embodiments are within the scope of the invention.

For example, the device may be mass-produced via a molding process that would employ suitable lightweight plastic for the breastplate, the extendible arm, and the cradle, and would allow molding of hardware fittings where practicable. Eliminating unneeded mass would result in a slimmer, lighter design. For example, the middle section of the tongue could be eliminated, and more of the mass of the cradle could be eliminated, and more of the mass of the cradle could be dispensed with. In general, the mass of all existing parts could be modified to the minimum consistent with durability, function, balance, and resonance when mated to the player's instrument.

Moreover, the length adjustment fitting for the extendible arm may be varied to allow or easier adjustment with one hand, while holding the instrument in playing position with the other hand. The prototype requires the player to loosen a cap screw and then extend or retract the forearm to the desired position and then retighten the cap screw. An alternative adjustment fitting might be a rack and pinion device similar to those used for focusing microscopes or binoculars or telescopes. Another adjustment fitting might be a tightening collar, similar to those used on the adjustable legs of tripods or easels, assuming the arms were cylindrical, rather than rectangular. Still another adjustment fitting might be a threaded bolt-like device that would screw into the upper arm. Yet another adjustment fitting might use a spring-loaded mechanism with a catch release button. Yet another adjustment might replace the socket-head cap screw at the tongue hole with a light-weight, knob-tightened fitting that would eliminate the need for an alien wrench in setting the vertical adjustment of the upper arm. Yet another change in the fittings might be the use of threaded inserts to accommodate the adjustment screws. Yet another change might be to make the balance beam adjustable in length. Yet another change might be to take the ring-holder notch of the balance beam movable upon the length of the beam. The option to customize devices to meet personal requirements of individual players would also exist.

Yet other changes, with reference to the resonating factors inherent in the device, might include the use of other woods and other materials that could serve to enhance the resonating characteristics of the device when mated with the player's instrument and body. Yet another change might include modifying the shape and density of the device to enhance the resonating characteristics of the device. For example, the cradle, instead of being a solid piece of material, could contain cavities that would further serve to enhance resonance.

The above description of a prototype is designed specifically for a trumpet. A device designed for trombone or French horn may vary from the prototype, but the principles underlying its design and use remain the same.

Other embodiments are within the scope of the following claims.

What is claimed is:

1. A stabilizing device for a smaller brass instrument, comprising first element that rests on the chest of a user of the instrument connected to a second element including a balance comprising a pivot on which the instrument can rest, further comprising an arm element having a first end in vertical pivot connection with the first element and a second end connected to the second element.

2. The device of claim 1, further comprising a neck strap connected to the first element.

3. The device of claim 2, wherein the first element includes an extension extending away from the chest of the user and connecting to the neck strap.

4. The device of claim 1, wherein the first element includes a vertical plate having a flat rear surface for resting against the chest of the user.

5. The device of claim 4, wherein the first element further includes a horizontally extending portion having a generally flat rear surface for contact with the chest of the user that provides horizontal stability to the device.

6. The device of claim 4, wherein the first element further includes an outwardly extending portion including a vertical pivot connection.

7. The device of claim 6, further comprising an arm element having a first end pivotally connected to the vertical pivot connection and a second end connected to the second element.

8. The device of claim 7, further comprising an extension assembly connected to the second element and slidably connected to the second end of the arm element.

9. The device of claim 8, wherein the extension assembly includes a rod slidably mounted to the arm element through an opening in the second end of the arm element.

10. The device of claim 9, wherein the extension assembly has an upper surface and the second element includes a rest element for the instrument rotatably mounted on the upper surface of the extension assembly.

11. The device of claim 1, further comprising an extension assembly connected to the second element and slidably connected to the second end of the arm element.

12. The device of claim 1, further comprising an extension element slidably connected to the first element.

13. The device of claim 12, wherein the extension assembly has an upper surface and the second element includes a rest element for the instrument rotatably mounted on the upper surface of the extension assembly.

14. The device of claim 1, wherein the device vibrates in response to a vibration of the instrument during use to thereby transfer the vibration through the device to the sternum of the user.

15. The device of claim 1, wherein said pivot comprises a horizontal pivot.

16. A stabilization device for a smaller brass instrument, comprising a breastplate assembly that rests on the chest of a user of the instrument, a neck strap connected to the breastplate assembly, an upper arm having a first end in vertical pivot connection with the breastplate assembly and a second end, a forearm and extension rod assembly slidably connected to the second end of the upper arm, and a cradle and pivot-dowel assembly that provides a pivoting balance for the instrument mounted on the forearm and extension rod assembly.

17. A stabilizing device for a smaller brass instrument, comprising a first element that rests on the chest of a user of the instrument connected to a second element that provides a pivoting balance for the instrument, wherein the first element includes a vertical plate having a flat rear surface for resting against the chest of the user, and wherein the first element further includes an outwardly extending portion including a vertical pivot connection.

18. The device of claim 17, further comprising an arm element having a first end pivotally connected to the vertical pivot connection and a second end connected to the second element.

19. The device of claim 18, further comprising an extension assembly connected to the second element and slidably connected to the second end of the arm element.

20. The device of claim 19, wherein the extension assembly includes a rod slidably mounted to the arm element through an opening in the second end of the arm element.

21. The device of claim 20, wherein the extension assembly has an upper surface and the second element includes a rest element for the instrument rotatably mounted on the upper surface of the extension assembly.

22. A stabilizing device for a smaller brass instrument, comprising a first element that rests on the chest of a user of the instrument connected to a second element that provides a pivoting balance for the instrument wherein the first element includes a vertical plate having a flat rear surface for resting against the chest of the user, wherein the first element further includes a horizontally extending portion having a generally flat rear surface for contact with the chest of the user that provides horizontal stability to the device.

23. A stabilizing device for a smaller brass instrument, comprising a first element that rests on the chest of a user of the instrument connected to a second element that provides a pivoting balance for the instrument, further comprising an arm element having a first end pivotally connected to a vertical pivot connection and a second end connected to the second element.

24. The device of claim 23, further comprising an extension assembly connected to the second element and slidably connected to the second end of the arm element.

25. A stabilizing device for a smaller brass instrument, comprising a first element that rests on the chest of a user of the instrument connected to a second element that provides a pivoting balance for the instrument, further comprising an extension assembly slidably connected to the first element.

26. The device of claim 25, wherein the extension assembly has an upper surface and the second element includes a rest element for the instrument rotatably mounted on the upper surface of the extension assembly.

27. A stabilizing device for a smaller brass instrument, comprising a first element that rests on the chest of a user of the instrument connected to a second element that provides a pivoting balance for the instrument, wherein the first element includes an outwardly extending portion including a vertical pivot connection.

28. A stabilizing device for a smaller brass instrument, comprising a first element that rests on the chest of a user of the instrument connected to a second element that provides a pivoting balance for the instrument, further comprising an arm element having a first end pivotally connected to a vertical pivot connection and a second end connected to the second element.

29. A stabilizing device for a smaller brass instrument, comprising a first element that rests on the chest of a user of the instrument connected to a second element that provides a pivoting balance for the instrument, further comprising an extension element slidably connected to the first element.

30. A stabilizing device for a smaller brass instrument, comprising a first element that rests on the chest of a user of the instrument connected to a second element that provides a pivoting balance for the instrument, further comprising a neck strap connected to the first element, wherein the first element includes an extension extending away from the chest of the user and connected to the neck strap.

31. A stabilizing device for a smaller brass instrument, comprising a first element that rests on the chest of a user of the instrument connected to a second element including a balance comprising a pivot on which the instrument can rest, further comprising a neck strap connected to the first, wherein the first element includes an extension extending away from the chest of the user and connecting to the neck strap.

32. A stabilizing device for a smaller brass instrument, comprising a first element that rests on the chest of a user of the instrument connected to a second element including a balance comprising a pivot on which the instrument can rest, wherein the first element includes a vertical plate having a flat rear surface for resting against the chest of the user, wherein the first element further includes a horizontally extending portion having a generally flat rear surface for contact with the chest of the user that provides horizontal stability to the device.

33. A stabilizing device for a smaller brass instrument, comprising a first element that rests on the chest of a user of the instrument connected to a second element including a balance comprising a pivot on which the instrument can rest, wherein the first element includes a vertical plate having a flat rear surface for resting against the chest of the user, wherein the first element further includes an outwardly extending portion including a vertical pivot connection, further comprising an arm element having a first end pivotally connected to the vertical pivot connection and a second end connected to the second element.

34. A stabilizing device for a smaller brass instrument, comprising a first element that rests on the chest of a user of the instrument connected to a second element including a balance comprising a pivot on which the instrument can rest, further comprising an extension element slidably connected to the first element.

* * * * *

UNITED STATES PATENT AND TRADEMARK OFFICE

CERTIFICATE OF CORRECTION

PATENT NO. : 6,504,087 B2
DATED : January 7, 2003
INVENTOR(S) : Matthew Benjamin Shulman It is certified that error appears in the above-identified patent and that said Letters Patent is hereby corrected as shown below:

Column 6,
Line 56, before "first" insert -- a --.

Signed and Sealed this

Eighth Day of June, 2004

JON W. DUDAS
*Acting Director of the United States Patent and Trademark Office*